US008056636B1

(12) United States Patent
Perry

(10) Patent No.: US 8,056,636 B1
(45) Date of Patent: Nov. 15, 2011

(54) JET PUMP WITH FOAM GENERATOR

(75) Inventor: Larry Perry, Chickasha, OK (US)

(73) Assignee: LP Chemical Service LLC OK (US)

( * ) Notice: Subject to any disclaimer, the term of this patent is extended or adjusted under 35 U.S.C. 154(b) by 171 days.

(21) Appl. No.: 12/396,864

(22) Filed: Mar. 3, 2009

Related U.S. Application Data

(60) Provisional application No. 61/068,047, filed on Mar. 3, 2008.

(51) Int. Cl.
*F04F 5/42* (2006.01)

(52) U.S. Cl. ..... 166/372; 417/171

(58) Field of Classification Search ..... 166/372, 166/51; 417/171, 151, 172
See application file for complete search history.

(56) References Cited

U.S. PATENT DOCUMENTS

| | | | | |
|---|---|---|---|---|
| 3,301,606 | A * | 1/1967 | Bruno | 406/85 |
| 3,377,139 | A | 4/1968 | MacGregor et al. | |
| 4,028,009 | A * | 6/1977 | Gudzenko et al. | 166/51 |
| 4,101,246 | A * | 7/1978 | Erickson | 417/171 |
| 4,213,936 | A | 7/1980 | Lodrick | |
| 4,457,375 | A | 7/1984 | Cummins | |
| 4,584,002 | A | 4/1986 | Cox et al. | |
| 4,681,164 | A | 7/1987 | Stacks | |
| 4,730,676 | A | 3/1988 | Luers et al. | |
| 4,796,702 | A | 1/1989 | Scherubel | |
| 5,033,545 | A * | 7/1991 | Sudol | 166/312 |
| 5,105,889 | A * | 4/1992 | Misikov et al. | 166/372 |
| 5,213,120 | A | 5/1993 | Dickson | |
| 5,356,565 | A | 10/1994 | Southwell | |
| 5,743,717 | A * | 4/1998 | Schmidt | 417/109 |
| 6,382,321 | B1 * | 5/2002 | Bates et al. | 166/372 |
| 6,422,734 | B1 | 7/2002 | Sethuraman et al. | |
| 6,602,916 | B2 | 8/2003 | Grundmann et al. | |
| 6,655,664 | B2 | 12/2003 | Chuang | |
| 7,124,822 | B2 | 10/2006 | Chatterji et al. | |
| 7,278,488 | B2 | 10/2007 | Leduc | |
| 2006/0045757 | A1 | 3/2006 | Parr | |
| 2009/0090503 | A1 * | 4/2009 | Groves | 166/249 |

FOREIGN PATENT DOCUMENTS

RU 2164314 C2 * 3/2001

* cited by examiner

*Primary Examiner* — Daniel P Stephenson
(74) *Attorney, Agent, or Firm* — Mitchell K. McCarthy

(57) ABSTRACT

A jet pumping system for use in a wellbore drilled for the production or petroleum products includes a packer disposed within the wellbore, an intake pipe extending through the packer, an injection system configured to inject pressurized gas into the wellbore and a jet pump connected to the intake pipe. The jet pump further includes a removable vortex generator. A method for selectively generating foam in-situ in a subterranean well includes the steps of installing a vortex generator in the jet pump with a wire line procedure and pumping a foam generating solution into the jet pump. Pressurized gas is injected into the annulus of the well, which creates a vortex in the jet pump as the pressurized gas is directed into the jet pump through injection ports. The resultant vortex aerates and mixes the foam generating solution and petroleum fluids to generate a foam in the jet pump.

20 Claims, 4 Drawing Sheets

JET PUMP WITH FOAM GENERATOR

RELATED APPLICATIONS

The present application claims the benefit of U.S. Provisional Patent Application No. 61/068,047, entitled "Foam Generator," filed Mar. 3, 2008, the disclosure of which is herein incorporated by reference.

FIELD OF THE INVENTION

The present invention relates generally to the field of gas lift and foam lift methodologies of fluid recovery in oil and gas wells and more particularly to an apparatus and method for improving the recovery of petroleum products from a subterranean well.

BACKGROUND OF THE INVENTION

Wells are drilled to extract oil and gas from subterranean reservoirs. Oil and gas typically enter the well from the producing reservoir through perforations in the well casing. Initially, the reservoir pressure may be sufficient to overcome the force of gravity and force oil and gas out of the well. As the reservoir pressure decreases, however, fluids may accumulate at the bottom of the wellbore and it may become necessary to employ artificial lift systems to harvest the oil and gas. Examples of artificial lift systems include surface-mounted sucker rod pumps, electrical submersible pumps, plunger-lifts and gas-lift systems.

Gas lift systems involve injecting gas through the tubing-casing annulus of the well to aerate the accumulated fluid at the bottom of the well. The injected gas aerates the fluid to reduce its density and the reservoir pressure is then able to lift the oil column and forces the fluid out of the wellbore. Gas may be injected continuously or intermittently, depending on the producing characteristics of the well and the arrangement of the gas-lift equipment.

Generally, the use of density-reducing foam in conjunction with gas lift systems has proven to be an efficient and cost effective method for improving the recovery of petroleum products from the wellbore. However, many current foam generators require that the foam be generated at the surface and then pumped down into the wellbore. Alternatively, foam generation equipment must be installed in the equipment string in the well, which requires shutting-in the well while the new equipment is installed and removed. There is therefore a need for an improved foam generator that can generate foam in-situ in the well-bore and that can be selectively activated without interrupting the production of oil and gas.

SUMMARY OF THE INVENTION

In a preferred embodiment, the present invention provides a jet pumping system for use in a wellbore drilled for the production or petroleum products. The jet pumping system includes a packer disposed within the wellbore, an intake pipe extending through the packer, an injection system configured to inject pressurized gas into the wellbore and a jet pump connected to the intake pipe. The jet pump further includes a removable vortex generator.

In another aspect, the present invention includes a method of selectively generating foam in-situ in a subterranean well. In a preferred embodiment, the method includes the steps of providing a jet pump in the subterranean well, installing a vortex generator in the jet pump with a wire line procedure and pumping a foam generating solution into the jet pump.

The foam is generated by injecting pressurized gas into the annulus of the well with a gas injection system, which creates a vortex in the jet pump as the pressurized gas is conducted into the jet pump through injection ports. The resultant vortex in the jet pump aerates and mixes the foam generating solution and petroleum fluids to generate a foam in the jet pump.

DETAILED DESCRIPTION OF THE PREFERRED EMBODIMENTS

Figure 1:
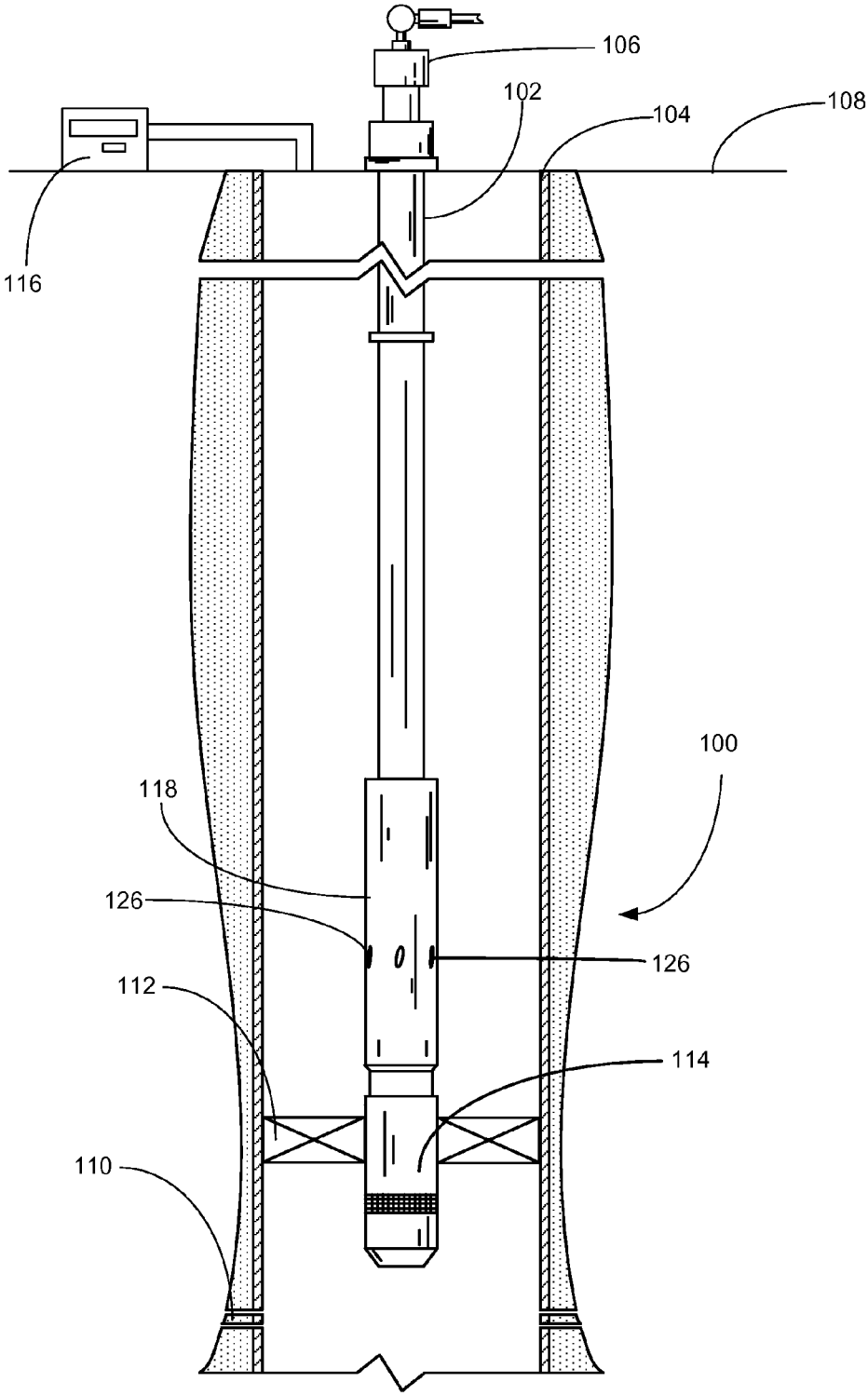
FIG. 1. is a side view of a jet pump system deployed in a wellbore.

In accordance with a preferred embodiment of the present invention, FIG. 1 shows an elevational view of a jet pumping system 100 attached to production tubing 102. The jet pumping system 100 and production tubing 102 are disposed in a wellbore 104, which is drilled for the production of a fluid such as water or petroleum. As used herein, the term "petroleum" refers broadly to all mineral hydrocarbons, such as crude oil, gas and combinations of oil and gas. The production tubing 102 connects the jet pumping system 100 to a wellhead 106 located on a surface 108. The surface 108 may be the ground, a vehicle, a drilling rig or an offshore production platform. Petroleum products enter the wellbore 104 from a producing formation through perforations 110. Although the pumping system 100 is primarily designed to pump petroleum products, it will be understood that the present invention can also be used to move other fluids.

The jet pumping system 100 generally includes a packer 112, an intake pipe 114, an injection system 116 and a jet pump 118. The packer 112, jet pump 118 and intake pipe 114 are preferably installed below the top of the fluid level in the wellbore 104. The packer 112 is installed in the annulus of the wellbore 104 and substantially isolates the jet pump 118 from the intake pipe 114. The injection system 116 generally includes a compressor and associated equipment and is configured to force air, produced hydrocarbon gas or other gas into the annulus of the wellbore 104. It will be appreciated by those of ordinary skill in the art that the injection system 116 may recycle some or all of the gas petroleum products recovered from the wellbore 104. Unless otherwise noted, all of the components of the jet pumping system 100 are constructed from steel, stainless steel or other metal suitable for use in a downhole environment.

The packer 112 prevents the injected gas from entering the jet pumping system 100 through the intake pipe 114 and from exiting the wellbore 104 through the perforations 110. In this way, the packer 112 forces the injected gas to enter the jet pumping system 100 through the jet pump 118. The intake pipe 114 extends through the packer 112 and provides a path for fluids to travel from the bottom of the wellbore 104 into the jet pumping system 100. It will be understood by those skilled in the art that the jet pumping system 100 may include additional components to facilitate the recovery of petroleum products from the wellbore 104.

Figure 2:
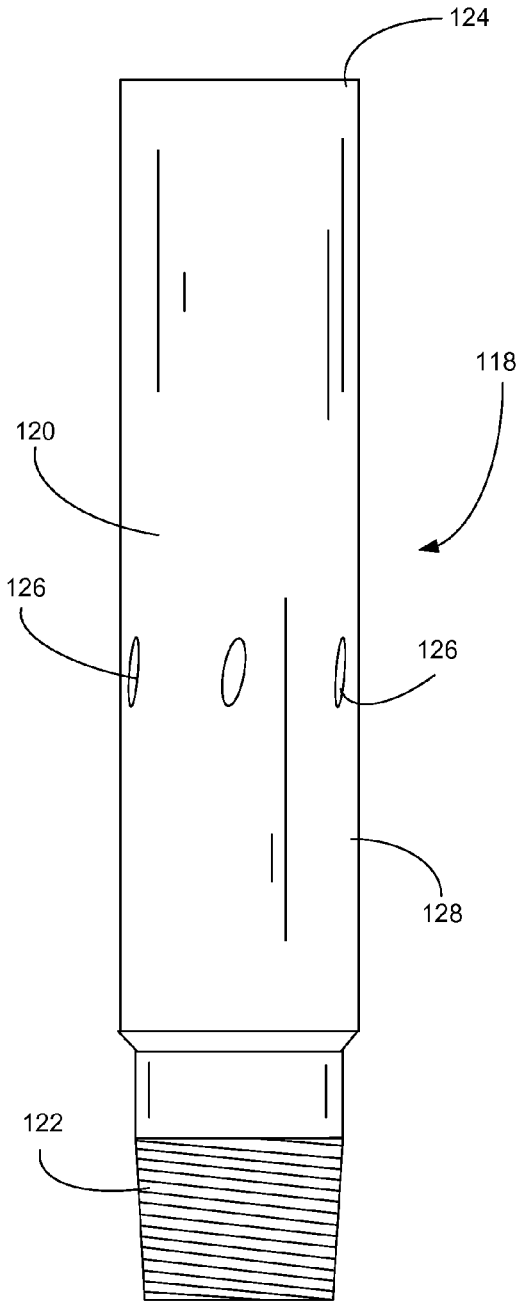
FIG. 2. is a side view of a jet pump constructed in accordance with a preferred embodiment of the present invention.
Figure 3:
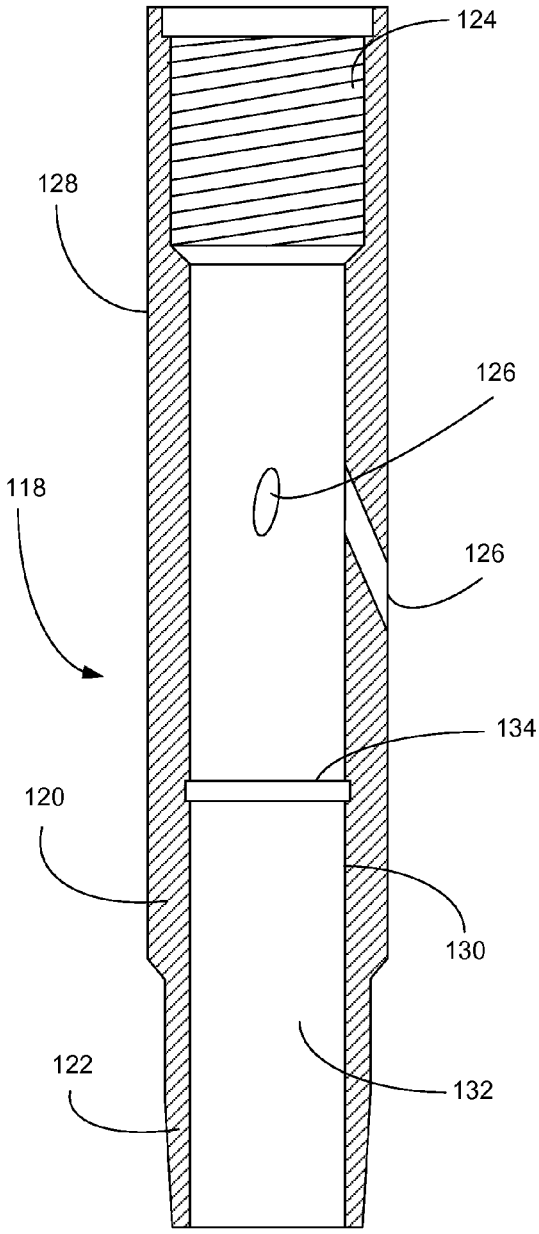
FIG. 3. is a side cross-sectional view of the jet pump of FIG. 2 with the vortex generator removed.

Turning to FIGS. 2 and 3, shown therein are elevational and cross-sectional views, respectively, of the jet pump 118. The jet pump 118 preferably includes a main body 120, an intake 122, a discharge 124 and a plurality of injection ports 126. In the preferred embodiment, the main body 100 is substantially cylindrical in shape. The intake 122 is tapered and externally threaded for connection with the intake pipe 114. The discharge 124 is internally tapered and threaded for connection with the production tubing 102. It will be understood by those skilled in the art that there are alternative ways to connect the jet pump 118 to the production tubing 102 and intake pipe 114.

The main body 120 includes an exterior surface 128, an interior surface 130, a central passage 132 that longitudinally extends along the length of the jet pump 118 and a locking slot 134. The locking slot 134 is positioned below the plurality of injection vents 126 and is recessed into the interior surface 130 of the jet pump 118. Injection ports 126 extend through the main body 120 from the exterior surface 128 to the interior surface 130. The injection ports 126 place the central passage 132 in fluid communication with the wellbore 104 surrounding the jet pump 118. In the presently preferred embodiment, the jet pump 118 includes six injection ports 126. It will be appreciated, however, that fewer or more injection ports 126 may also be used with the jet pump 118.

Figure 4:
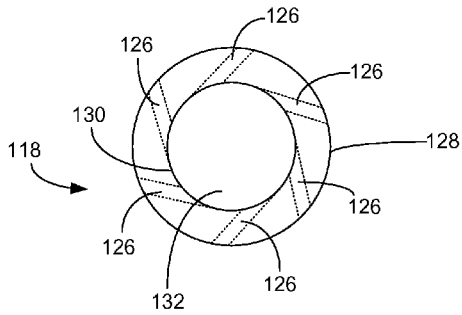
FIG. 4. is a cross-sectional view of the jet pump of FIG. 3, illustrating the angular disposition of the intake ports.

As shown in the cross-sectional view of FIG. 3, the injection ports 126 are disposed at a non-horizontal angle and upward direction through the main body 120. As shown in the cross-sectional representation of FIG. 4, the injection ports 126 are also radially distributed around the main body 120 in an equally offset, tangential fashion that increases the length of the injection port 126. The elevated, angular disposition of the injections ports 126 promotes an upward, rotating flow profile within the central passage 132 of the jet pump 118.

Figure 5:
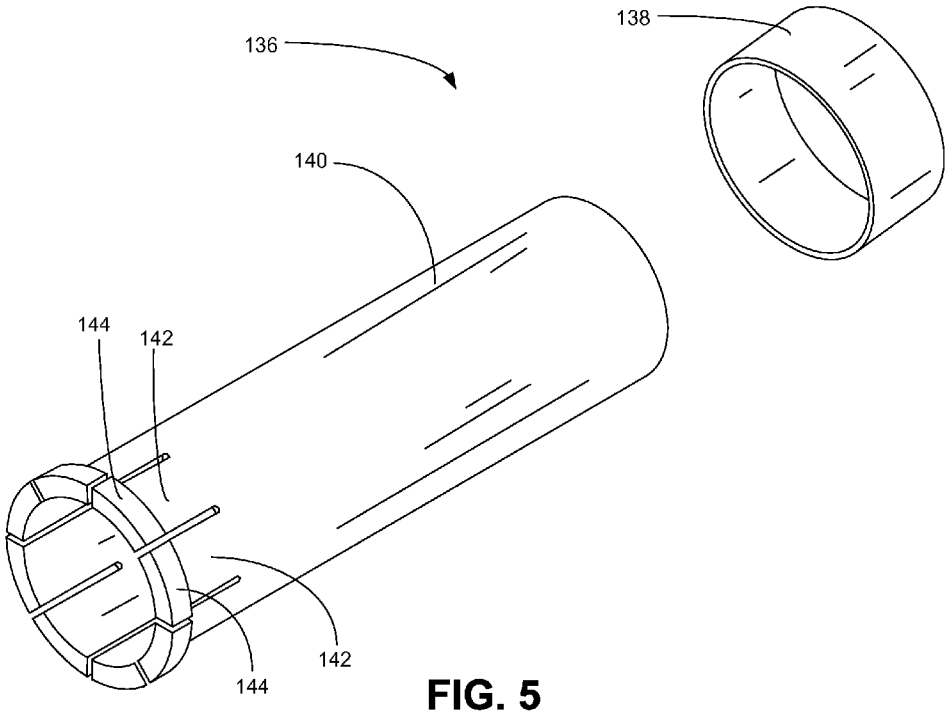
FIG. 5. is a perspective view of the vortex generator and locking collar of the jet pump of FIG. 2.

Turning to FIG. 5, shown therein is a perspective view of a vortex generator 136 and locking collar 138. The vortex generator 136 includes a tube body 140 and a plurality of locking tines 142. The tube body 140 is preferably configured as a hollow cylinder configured with an outer diameter that is slightly less than the diameter of the interior surface 130 of the main body 120. Each of the plurality of locking tines 142 includes a locking flange 144. Each locking flange 144 extends outward from the locking tine 142. The locking flanges 144 are sized and configured to be received by the locking slot 134 in the main body 120.

The locking collar 138 is a generally formed as a cylindrical ring that is configured to slide over the tube body 140 into a position adjacent the locking tines 142. Alternatively, the locking collar 138 can be configured as a split-ring or "c-clamp." The locking collar 138 prevents excessive vibration of the tube body 140 during operation of the jet pump 118.

Figure 6:
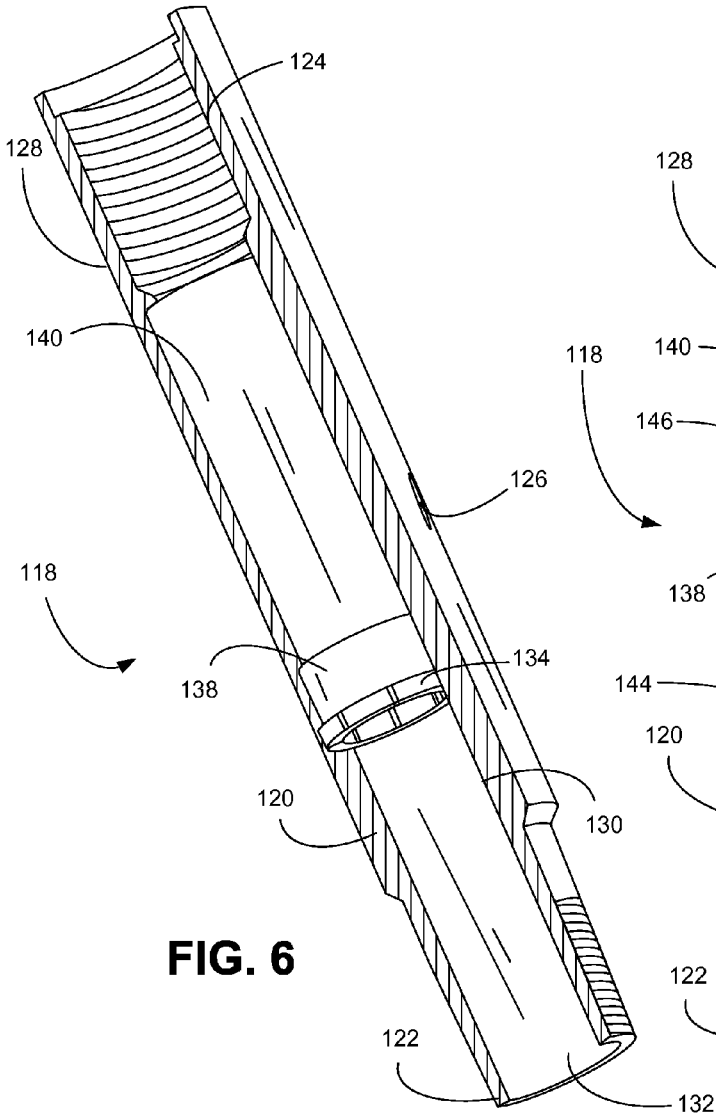
FIG. 6. is a partial cross-sectional perspective view of the jet pump of FIG. 2 with the vortex generator installed.
Figure 7:
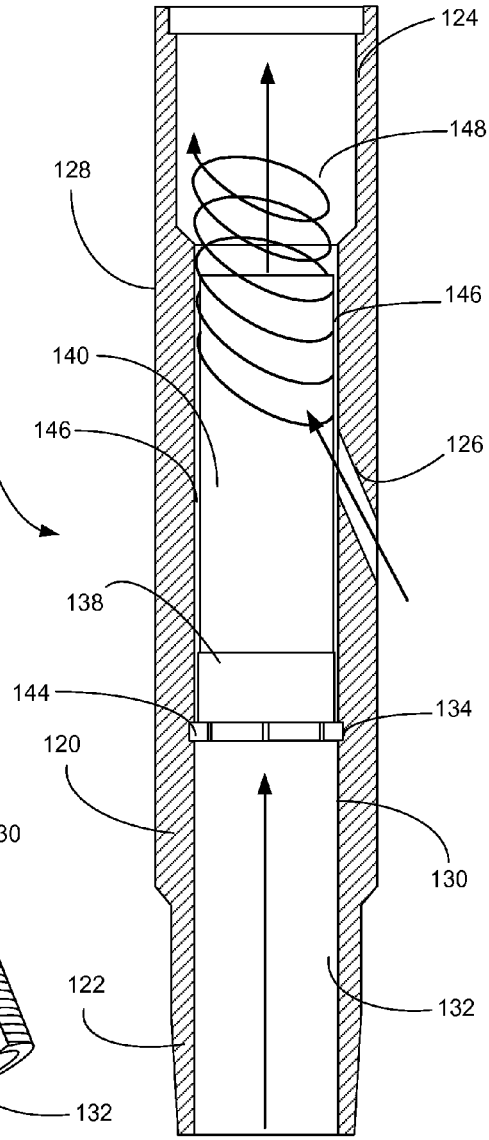
FIG. 7. is a partial cross-sectional view of the jet pump of FIG. 6 with the vortex generator installed.

Turning to FIGS. 6 and 7, shown therein are perspective and elevational views in cross-section of the assembled jet pump 118. The vortex generator 136 is installed within the central passage 132 of the main body 120. During installation, the locking tines 142 deform slightly as the locking flanges 144 pass through the central passage 132. When the locking flanges 144 reach the locking slot 134, the locking flanges 144 expand outward to hold the vortex generator 136 in a stationary position within the jet pump 118. The locking collar 138 can then be placed over the tube body 140 to dampen the vibration of the vortex generator 136.

Significantly, installation of the vortex generator 136 creates an annular space 146 (see FIG. 7) between the interior surface 130 and the tube body 140. The confined geometry of the annular space 146 causes gases injected through the injection ports 126 to accelerate as they enter the central passage 132. The acceleration of the injected gases increases turbulence within the central passage 132 and the formation of a vortex flow profile 148 near the discharge 124 of the jet pump 118. The acceleration of the injected gases around the vortex generator 136 also creates a pressure drop that aids in the movement of petroleum products through the jet pump 118.

The vortex generator 136 can be removed from the jet pump 118 without shutting in the well or removing the jet pump 118. A vortex generator removal tool (not shown) is lowered into the jet pump 118 with a wire line. The vortex generator removal tool engages the locking tines 142 and compresses them inward so that the locking flanges 144 disengage from the locking slot 134. Once the locking flanges 144 are disengaged from the locking slot 134, the vortex generator 136 may be pulled back up the jet pump 118 and production tubing 102. Removing the vortex generator 136 from the main body 120 of the jet pump 118 likewise removes the annular space 146. Without the annular space 146, gases and fluids flowing through the injection ports 126 will not experience an increase in velocity as they enter the central passage.

In a preferred method of operation, a foam generating solution is injected into the production tubing 102. The foam generating solution mixes with the fluids near the jet pump 118. After the foam generating solution has been added to the jet pumping system 100, pressurized gas is injected into the wellbore 104 with the injection system 116. The pressurized gas travels down the annulus of the wellbore 104 to the vicinity of the packer 112 and enters the plurality of injection ports 126 in the jet pump 118. If a column of liquid is present in the annulus above the packer 112, the column of liquid may also be pushed through the injection ports 126 into the jet pump 118.

The angular and radial orientation of the injection ports 126 causes the pressurized injection gases to assume an upward rotational flow profile in the central passage 132, as depicted by flow arrows 148 in FIG. 7. Additionally, the restricted flow path provided by the annular space 146 increases the velocity (both vertical velocity and rotational velocity) of the injected fluids due to the Venturi effect. As the pressurized gases travel upward through the annular space 146, they obtain a uniform rotation such that when the pressurized gas passes from the annular space 146 into the discharge 124 of the jet pump 118, the pressurized fluids assume the characteristics of a vortex.

The vortex agitates and mixes the injected gases with fluids present in the jet pump 118. In the presence of foam generating solution, the agitation and mixing created by the vortex in the jet pump 118 creates a highly aerated, low-density foam consisting of petroleum products, injection gas and foam generating solution. The vortex significantly improves the effectiveness of the foam generating solution. As the vortex generator 136 creates foam within the jet pump 118, the foam rises upward through the production tubing 102 to the wellhead 106 and surface-mounted separation, refining and storage facilities.

It will be appreciated that the present invention may find utility without the use of a foam generating solution. For example, the agitation and aeration provided by the vortex generator 136 may improve the recovery of petroleum products from the wellbore 104 without the addition of a foam generating solution.

It is to be understood that even though numerous characteristics and advantages of various embodiments of the present invention have been set forth in the foregoing description, together with details of the structure and functions of various embodiments of the invention, this disclosure is illustrative only, and changes may be made in detail, especially in matters of structure and arrangement of parts within the principles of the present invention to the full extent indicated by the broad general meaning of the terms in which the appended claims are expressed. It will be appreciated by those skilled in the art that the teachings of the present invention can be applied to other systems without departing from the scope and spirit of the present invention.

It is claimed:

1. A jet pumping system for use in a wellbore that is selectively pressurized by an injection system configured to inject pressurized gas into the wellbore, the jet pumping system comprising:

a packer disposed within the wellbore;

an intake pipe extending through the packer;

and a jet pump having an interior surface, the interior surface defining a longitudinal passage fluidly connected to the intake pipe, and the jet pump having a vortex generator, the interior surface and the vortex generator operably defining an annular space therebetween.

2. The jet pumping system of claim 1, wherein the jet pump further comprises a plurality of injection ports extending non-radially through the interior surface in relation to the longitudinal passage and fluidly communicating the pressurized gas in the well bore with the longitudinal passage.

3. The jet pumping system of claim 2, wherein each of the plurality of injection ports is disposed at a non-horizontal angle through the jet pump.

4. The jet pumping system of claim 2, wherein each of the plurality of injection ports is disposed in a semi-tangential form through the jet pump.

5. The jet pumping system of claim 1, wherein the vortex generator comprises:

a tube body;

a plurality of locking tines; and a plurality of locking flanges.

6. The jet pumping system of claim 5, wherein the jet pump further comprises a locking slot recessed within the interior surface, wherein the locking slot is configured to accept the locking flanges of the vortex generator.

7. The jet pumping system of claim 5, wherein the vortex generator comprises a locking collar operably adjacent the locking tines and locking flanges.

8. The jet pumping system of claim 1, wherein the longitudinal passage is characterized as a first passage and the vortex generator defines a second passage in fluid communication with the first passage.

9. A jet pump comprising:

a main body defining a longitudinal passage;

an intake fluidly connected to the longitudinal passage;

a discharge fluidly connected to the longitudinal passage;

a plurality of injection ports extending non-radially through the main body in relation to the longitudinal passage to impart a rotational flow profile to a fluid flowing from outside the main body into the longitudinal passage; and a vortex generator disposed within the longitudinal passage.

10. The jet pump of claim 9, wherein the vortex generator comprises:

a tube body;

a plurality of locking tines each connected to the tube body; and a plurality of locking flanges each depending from the locking tines.

11. The jet pump of claim 10, wherein the main body and the tube body operably define an annular space therebetween.

12. The jet pump of claim 10, wherein the main body defines a slot configured to accept the locking flanges.

13. The jet pump of claim 12 wherein the plurality of locking flanges are selectively moveable between first radial positions and second radial positions, whereby at the first radial positions the locking flanges lockingly engage the slot to affix the vortex generator in the main body, and whereby at the second radial positions the locking flanges clearingly disengage the slot making the vortex generator removable from the main body.

14. The jet pump of claim 10, wherein the vortex generator further comprises a locking collar operably adjacent the locking tines and locking flanges.

15. The jet pump of claim 9, wherein the plurality of injection ports are disposed at a non-horizontal angle through the main body.

16. The jet pump of claim 9, wherein the plurality of injection ports are disposed in a semi-tangential form through the main body of the jet pump.

17. The jet pump of claim 9, wherein the longitudinal passage is characterized as a first passage and the vortex generator defines a second passage fluidly connected to the first passage.

18. The jet pump of claim 9, wherein the vortex generator is disposed adjacent the plurality of injection ports.

19. A method of selectively generating foam in-situ in a subterranean well, the method comprising the steps of:

providing a jet pump in the subterranean well;

installing a vortex generator in the jet pump with a wire line procedure;

pumping a foam generating solution into the jet pump;

injecting pressurized gas into the annulus of the well with a gas injection system;

creating a vortex in the jet pump by directing the pressurized gas into the jet pump through injection ports; and aerating and mixing the foam generating solution and petroleum fluids to generate a foam in the jet pump.

20. The method of claim 19 further comprising the step of removing the vortex generator with a wire line procedure without shutting-in the subterranean well.

* * * * *